US005560329A

United States Patent [19]

Hayman

[11] Patent Number: 5,560,329

[45] Date of Patent: Oct. 1, 1996

[54] VALVETRAIN FOR A PUSHROD ENGINE

[75] Inventor: Alan W. Hayman, Rochester, Mich.

[73] Assignee: General Motors Corporation, Detroit, Mich.

[21] Appl. No.: 535,992

[22] Filed: Sep. 29, 1995

Related U.S. Application Data

[63] Continuation-in-part of Ser. No. 332,598, Oct. 31, 1994, abandoned.

[51] Int. Cl.[6] ..... F01L 1/34; F01L 1/04; F02B 75/22

[52] U.S. Cl. ..... 123/90.31; 123/90.17; 123/54.4

[58] Field of Search ..... 123/90.15, 90.17, 123/90.31, 90.6, 54.4, 54.5, 54.6, 54.7, 54.8

[56] References Cited

U.S. PATENT DOCUMENTS

| | | | |
|---|---|---|---|
| 1,693,832 | 12/1928 | Vincent | 123/90.61 |
| 1,980,379 | 11/1934 | Burnett | 123/90.31 |
| 2,907,311 | 10/1959 | Waldron | 123/90.15 |
| 4,058,092 | 11/1977 | Hikosaka et al. | 123/54.4 |
| 4,723,516 | 2/1988 | Slagley et al. | 123/90.61 |
| 4,955,330 | 9/1990 | Fabi et al. | 123/90.31 |
| 4,957,078 | 9/1990 | Ohkawa et al. | 123/90.31 |
| 5,033,327 | 7/1991 | Lichti | 74/568 R |
| 5,090,364 | 2/1992 | McCarroll et al. | 123/90.16 |
| 5,181,485 | 1/1993 | Hirose et al. | 123/90.17 |
| 5,327,859 | 7/1994 | Pierik et al. | 123/90.17 |
| 5,398,648 | 3/1995 | Spath et al. | 123/90.16 |
| 5,402,756 | 4/1995 | Bohme et al. | 123/90.16 |

*Primary Examiner*—Weilun Lo
*Attorney, Agent, or Firm*—Karl F. Barr, Jr.

[57] ABSTRACT

An internal combustion engine has a crankcase, a cylinder bank extending from the crankcase and a crankshaft disposed in the crankcase. A cylinder in the cylinder bank is closed by a cylinder head which carries intake and exhaust valves for regulating the flow of gasses through the cylinder. An intake and an exhaust camshaft are rotationally disposed within the crankcase and are driven by the crankshaft. The intake camshaft has a cam lobe which operates the intake valve through a pushrod extending between the cam lobe and the valve and the exhaust camshaft has a cam lobe which operates the exhaust valve through a pushrod extending between the cam lobe and the valve. The use of separate intake and exhaust camshafts separates the intake valve actuation event from that of the exhaust valve and allows the application of camshaft phasing to vary the opening relationship, or timing of the intake and the exhaust valves. In addition, the use of two camshafts facilitates the use of multi-step cam lobe.

3 Claims, 6 Drawing Sheets

VALVETRAIN FOR A PUSHROD ENGINE

This is a Continuation-In-Part of Ser. No. 08/332,598 filed on Oct. 31, 1994, now abandoned.

TECHNICAL FIELD

The invention relates to valve trains for internal combustion, pushrod engines.

BACKGROUND

Variation of valve actuation events in an automotive internal combustion engine provides improved low speed combustion processes and resultant system power output without sacrificing desired engine operating characteristics at high engine speed. Engines having pushrod actuated valve trains traditionally exhibit less flexibility with respect to valve train variability due to the location of the intake and exhaust valve actuators, or cam lobes, on a single crankshaft driven camshaft such as is illustrated in FIG. 1. In such an engine, a single rotating camshaft is typically located in the valley of the engine block above, and parallel to, the engine crankshaft. The camshaft actuates the intake and the exhaust valves via cam followers, pushrods and rocker arms. Because the inlet and exhaust valve events are fixed, relative to one another by placement of the inlet cam lobes 2 and exhaust cam lobes 4 on the same shaft, the timing or relationship of the events can not be easily altered.

A two-step cam follower is known, having two cylinders with a coincident longitudinal axis. The outer cylinder may be used for "high-lift" valve events and is operated on by a first pair of spaced cam lobes 6 of shaft 5' as is illustrated in FIG. 2, and the inner cylinder may be utilized for "low-lift" valve events and is acted on by a second cam lobe 7 between the first pair of lobes 6. As is evident from the illustrations of FIGS. 1 and 2, implementation of a two-step cam follower requires a greater investment in axial camshaft length, per valve, than in a non-variable system. In an internal combustion engine having a pushrod actuated valve train with specific, fixed cylinder bore center distances, the axial shaft distance between camshaft bearings may not permit the packaging of a two-step follower system.

SUMMARY OF THE INVENTION

The present invention relates to an internal combustion engine having a pushrod actuated valve train. The subject engine has improved valve actuation which facilitates variation of valve lift and timing during engine operation. The subject engine has a crankcase, housing a piston driven crankshaft. First and second cylinder banks extend from the crankcase to each define a cylinder bank, and associated plane. The cylinder bank planes intersect at the crankshaft axis and are inclined at an angle, relative to one another, to thereby establish the crankcase valley therebetween. A first camshaft is driven by the crankshaft and includes a first series of valve actuating cam lobes, and a second camshaft, preferably driven from the first camshaft by a chain or gear, has a second set of valve actuating lobes. The first camshaft controls the actuation of either the intake or the exhaust valves and the second camshaft controls the actuation of the other set of valves. In the present invention, the first and second camshafts extend in parallel to the crankshaft axis and are located along a plane which extends through the crankshaft axis and bisects the crankcase valley.

The application of multiple camshafts to a pushrod engine facilitates the application of physically larger, two-step cam followers by eliminating the requirement of locating both intake and exhaust cam lobes on a single shaft of limited axial length.

In addition, the separation of the intake and exhaust actuators in the pushrod engine allows the use of conventional camshaft phasing mechanisms which are not applicable in engines having the intake and exhaust actuation events controlled by a single shaft. Camshaft phasing allows the timing of the intake and exhaust valve events to be varied, relative to one another by varying the relative rotations of the two camshafts. Such a variation changes the flow characteristics through the engine cylinders.

In some cases it may be useful to utilize a two-step cam follower with cam phasing and such an application is made possible by the present invention.

Other objects and features of the invention will become apparent by reference to the following description and to the drawings.

DESCRIPTION OF THE PREFERRED EMBODIMENTS

Figure 1:
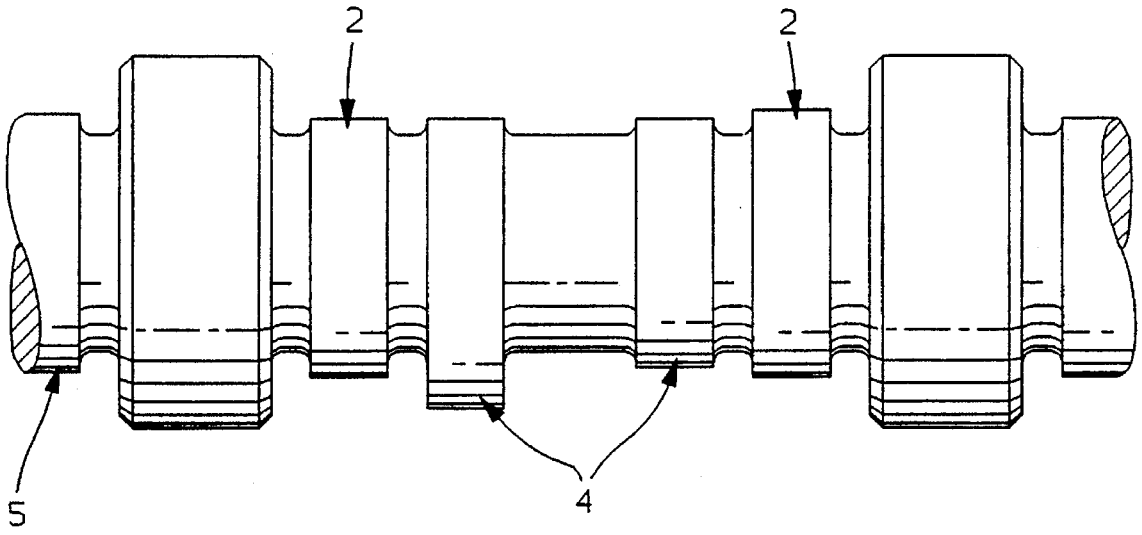
PRIOR ART FIG. 1
FIG. 1 is a partial view of a known camshaft for a pushrod engine having inlet and exhaust cams.
Figure 2:
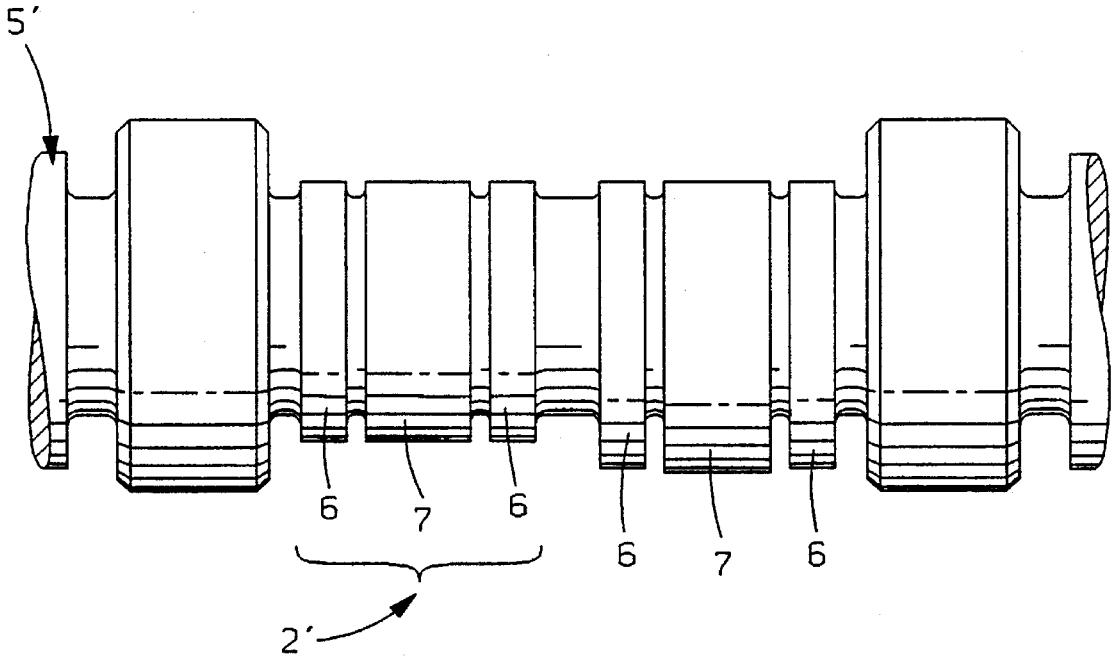
PRIOR ART FIG. 2
FIG. 2 is a partial view of a known camshaft for use with two-step cam followers.
Figure 3:
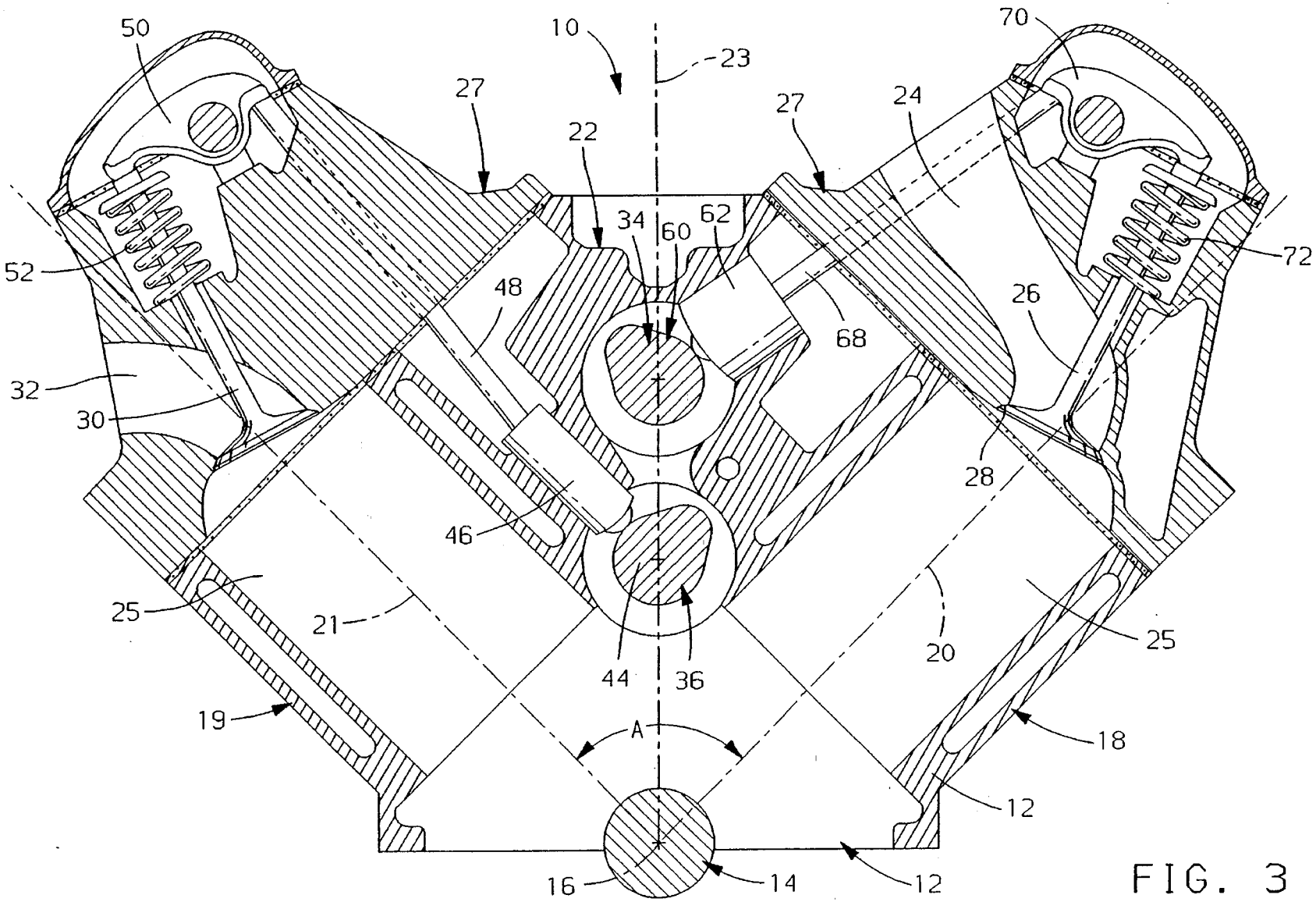
FIG. 3 is a sectional view of an internal combustion engine which incorporates features of the present invention.

Referring first to FIG. 3, a V-configured, internal combustion engine, designated generally as 10, is shown. The engine 10 includes crankcase 12 having a crankshaft 14 mounted for rotation therein along a longitudinal crankshaft axis 16. Cylinder banks 18,19 extend from the crankcase 12 and define cylinder bank planes 20,21 which intersect one another at the crankshaft axis 16. The cylinder banks 18,19 and their respective planes 20,21, are inclined with respect to one another at an angle "A" which defines a crankcase valley 22 therebetween. A vertical plane 23, which extends through crankshaft longitudinal axis 16, bisects the crankcase valley 22. In FIG. 3, the cylinder banks are, for example, inclined at a ninety degree angle to one another. The cylinder banks 18 include piston cylinders 25 housing pistons (not shown) which drive the crankshaft through a mechanical linkage. The cylinders 25 are closed at their upper or outer ends by cylinder heads 27 which, in cooperation with the pistons, establish combustion chambers in the cylinders 25. A fuel air mixture enters each of the cylinders 25 through an associated intake runner 24 in the cylinder heads 27, with the timing of the charge entry controlled by an intake poppet valve 26 disposed in a valve seat 28 situated between the intake runner 24 and the piston cylinder 25. In a similar fashion, the products of the combustion of the fuel/air mixture exit the piston cylinders 25 through exhaust valves 30 and corresponding exhaust runners 32 in the heads 27.

Figure 4:
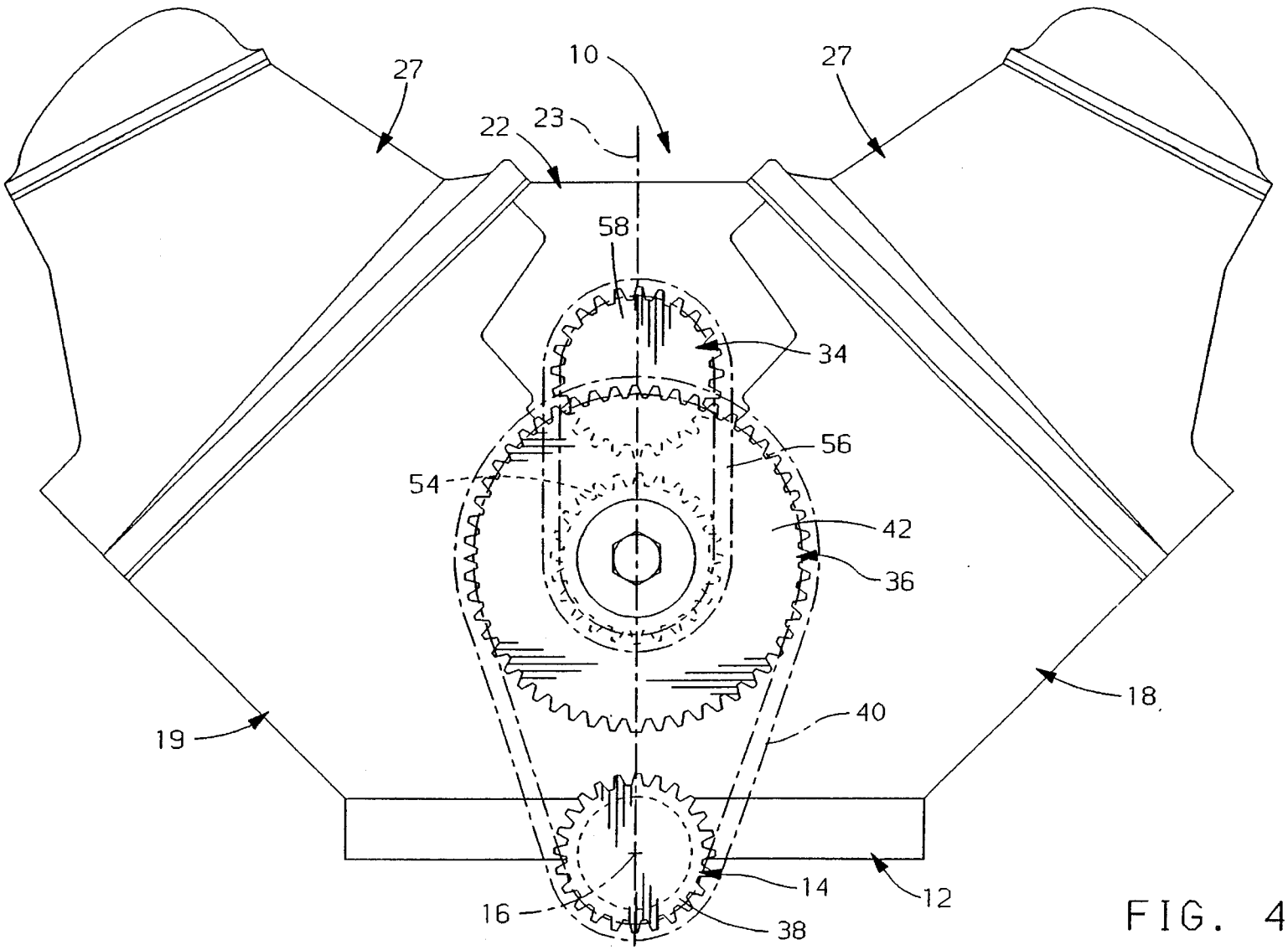
FIG. 4 is a front view of the internal combustion engine of FIG. 3, with a camshaft drive configuration shown in phantom.
Figure 5:
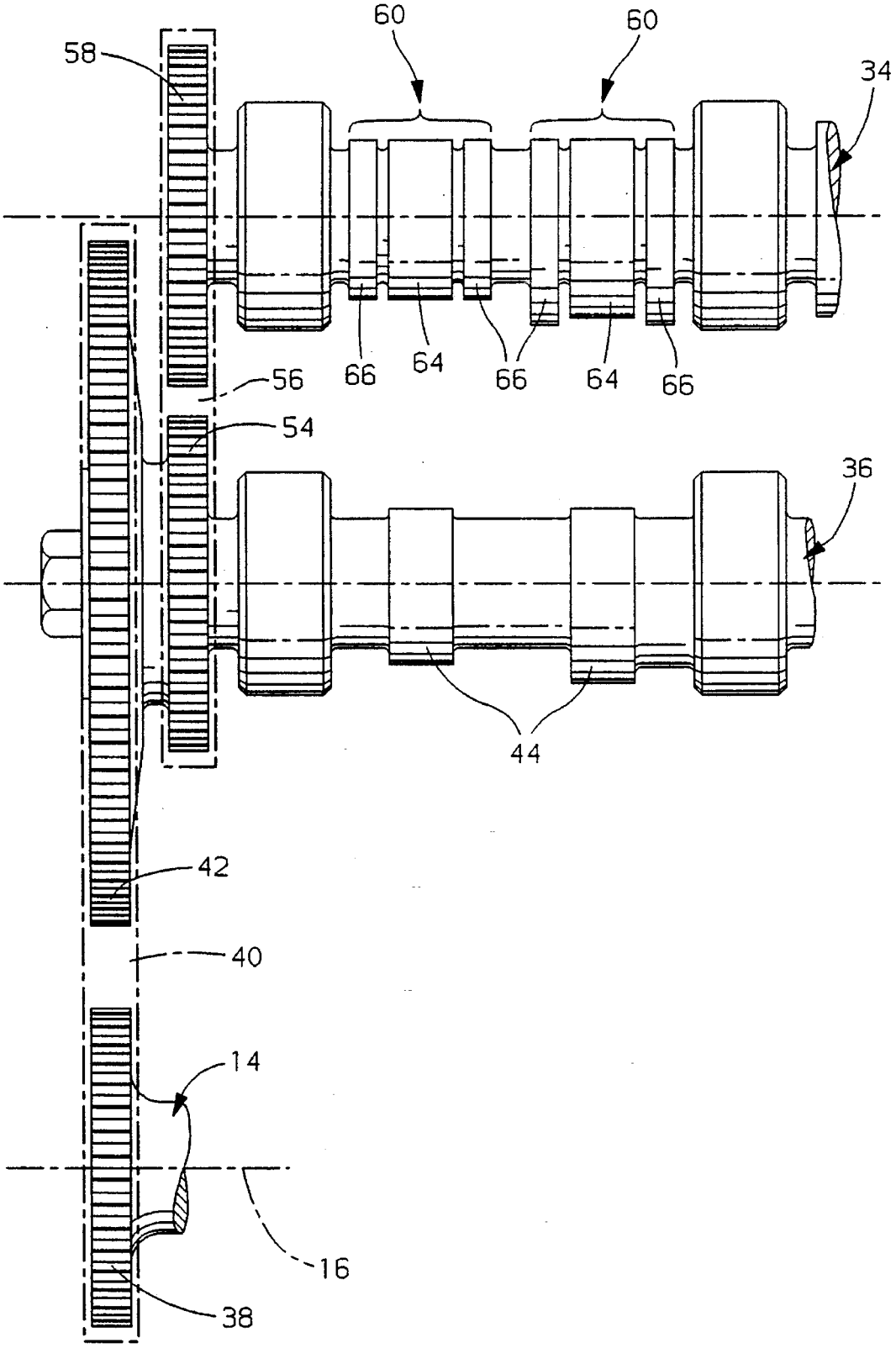
FIG. 5 illustrates the drive configuration for the camshafts in the engine of FIG. 3.
Figure 7:
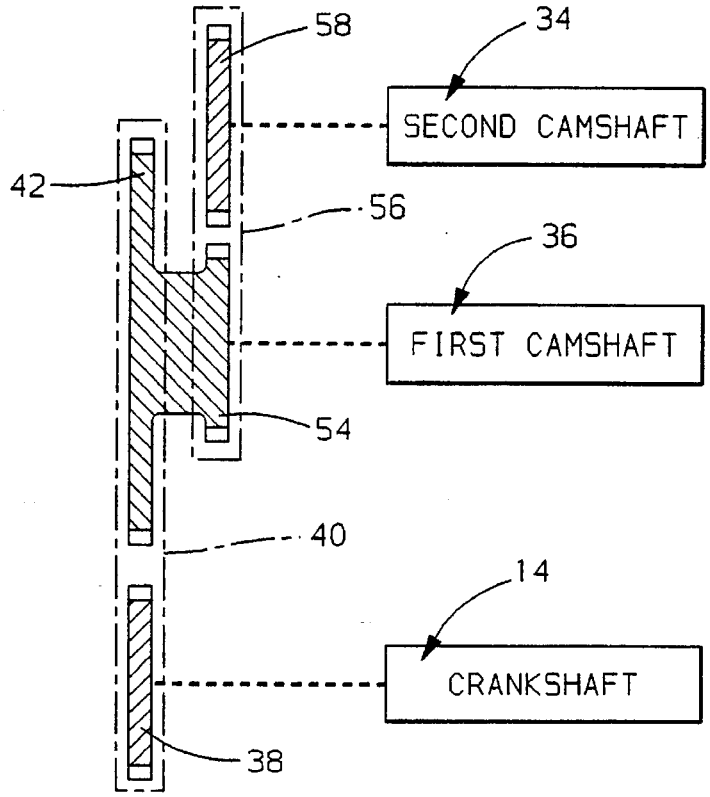
FIGS. 7 and 8 are schematic views of the camshaft drive configurations of FIGS. 5 and 6, respectively.

The opening and closing of the intake 26 and exhaust valves 30, referred to as valve events, are controlled, through mechanical means, by the rotation of first and second camshafts 34 and 36, respectively. In the preferred embodiment of the invention disclosed herein, the intake camshaft is represented by the camshaft 34 and the exhaust camshaft is represented by the camshaft 36, however, it should be noted, the assignment of a particular camshaft to actuate the intake or exhaust valves may be varied with design application. The intake and exhaust camshafts 34,36 extend in longitudinal, parallel orientation to the longitudinal crankshaft axis 16 and are both located along vertical plane 23, bisecting valley 22 of the engine crankcase 12 with the intake camshaft 34 located above (as viewed in the Figures) and parallel to the exhaust camshaft 36. Rotational drive from the crankshaft 14 is through a chain, a belt, or a gearset which engages the camshaft 36 and typically reduces the camshaft rotation by one-half of the crankshaft rotation for a four cycle engine. FIGS. 4, 5 and 7 illustrate a preferred apparatus for driving exhaust camshaft 36 in which crankshaft 14 includes a sprocket 38 which, through chain 40, drives exhaust camshaft 36 through a corresponding sprocket 42 on the camshaft. The exhaust camshaft 36 has a series of axially spaced cam lobes 44 disposed thereon which act on a valve actuation mechanism to open the exhaust valves 30 at the appropriate time and for the proper duration as is determined by the cam lobe profile and its location in the rotation of the shaft 36. The valve actuating mechanism for a pushrod engine of the type described herein may typically include a cam follower 46, a pushrod 48, extending from the follower through the crankcase 12 and cylinder head 27, and a rocker arm 50 which translates the movement of the pushrod 48 into an opening and closing force on the end of the exhaust valve 30. The opening force on the valve 30 is resisted by a closing force exerted by the compression spring 52.

In a similar manner, the intake camshaft 34 is located in plane 23, above (as viewed in the Figures) and parallel to the crankshaft 14 and the exhaust camshaft 36. Rotational drive for the camshaft 34 is through a chain, a belt, or a gear which engages the exhaust camshaft 36. Referring to FIGS. 4, 5 and 7, a preferred apparatus for driving intake camshaft 34 is shown. Exhaust camshaft 36 includes a second drive sprocket 54 which, through chain 56, drives intake camshaft 34 through a corresponding sprocket 58 on the intake camshaft 34. Sprockets 54 and 58 are typically sized such that the intake and exhaust camshafts are driven at the same rotational speed. In the embodiment described herein, the intake camshaft 34 has a series of axially spaced cam lobes 60 disposed thereon which act on a valve actuation mechanism to open the intake valves 26 at the appropriate time and for the proper duration as is determined by the cam lobe profile and its location in the rotation of the shaft 34. As is illustrated in FIG. 5, however, the cam profile for the intake valves of the present engine are configured to be used with a two-step cam follower 62 of the type disclosed in U.S. application Ser. No. 08/251,702 filed May 31, 1994 and owned by the assignee of the present application. With such a follower, an inner cylinder, or low-lift follower, rides on the inner or center cam of a set of three closely spaced cams on the camshaft 34. The low-lift cam 64 and follower is operable during low speed engine operation with the cam having a profile well suited to such operation. Hydraulic actuation of the cam follower 62 will subsequently engage the outer cylinder, or high-lift follower, which rides on the outer two cams 66 on the camshaft which are better suited to high speed engine operation. Such a variable lift cam and actuator provide flexibility in the operating characteristics of the engine across its entire operating range and, is made possible in the pushrod engine due to the application of a second camshaft. The valve actuating mechanism for the intake valves 26 includes, in addition to two-step cam follower 62, a pushrod 68 which extends from the follower through the crankcase 12 and cylinder heads 18, and a rocker arm 70 which translates the movement of the pushrod 68 into an opening and closing force on the end of the intake valve 26. The opening force on the valve 26 is resisted by a closing force exerted by the compression spring 72.

Figure 6:
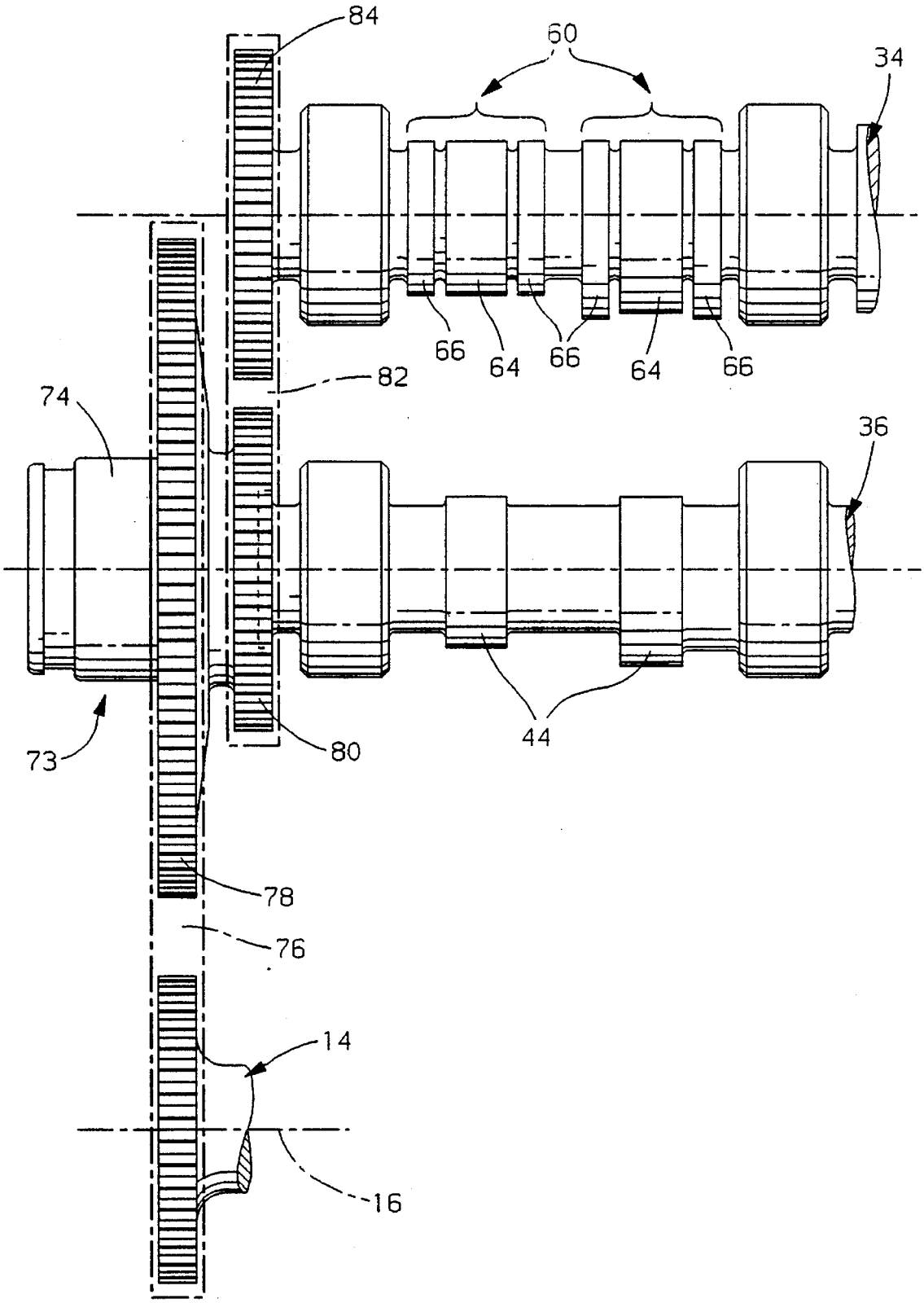
FIG. 6 illustrates a second embodiment of the drive configuration for the camshafts in the engine of FIG. 3.
Figure 8:
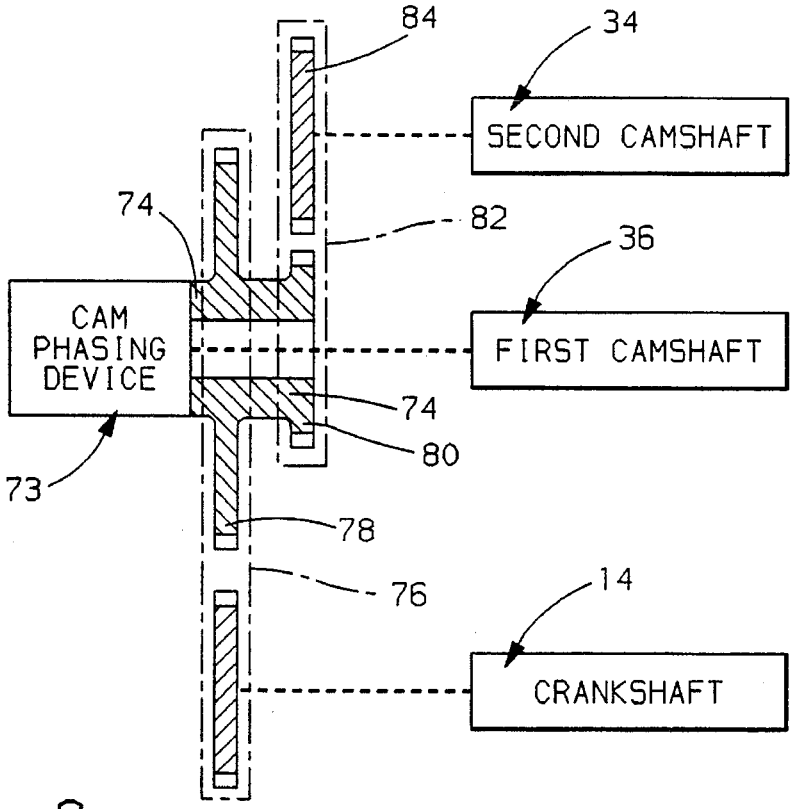

In addition to the application of two-step or variable lift cam followers to a pushrod engine, facilitated by separate intake and exhaust camshafts 34 and 36, the dual camshaft arrangement allows the relative rotation of the two shafts to be varied during operation through the application of a cam phasing device 73 of the type shown in FIGS. 6 and 8. It may be desirable to vary the timing of the intake and the exhaust events by moving the cam lobes 44 of the exhaust camshaft 36, relative to those of the intake camshaft 34 to thereby vary the amount of valve overlap occurring, and valve opening and closing points, during different operating ranges of the engine. Crankshaft 14 drives the cam phaser housing 74 through chain 76 and sprocket 78 on the housing. A second sprocket 80 on housing 74 directly drives the intake camshaft 34 through chain 82 and sprocket 84. Exhaust camshaft 36 is, however, indirectly driven through cam phasing apparatus 73, of the type disclosed in U.S. Pat. No. 5,033,327, issued Jul. 23, 1991, in the name of Lichti et al. allowing the rotation of the exhaust camshaft 36 to be varied, relative to the rotation of the intake camshaft 34.

As should be evident from the description provided, the multiple camshaft pushrod engine 10 is subject to several variations. For example, a pushrod engine is now available in which the intake camshaft, the exhaust camshaft, or both camshafts may now include two-step cam followers allowing both intake and exhaust events to be varied.

In addition, the application of intake and exhaust cam phasing is possible with the disclosed pushrod engine and may be used with or without variable valve actuation using two-step followers. In some applications it is now possible to vary the operational profile of the valve actuation events while simultaneously varying the relative timing of the intake and exhaust events.

While the multiple camshaft pushrod engine of the present invention has been disclosed and described for application to a V-configured internal combustion engine, it is contemplated that this improvement can be utilized on an inline pushrod engine as well.

The foregoing description of the preferred embodiment of the invention has been presented for the purpose of illustration and description. It is not intended to be exhaustive nor is it intended to limit the invention to the precise form disclosed. It will be apparent to those skilled in the art that the disclosed embodiments may be modified in light of the above teachings. The embodiments described were chosen to provide an illustration of the principles of the invention and its practical application to thereby enable one of ordinary skill in the art to utilize the invention in various embodiments and with various modifications as are suited to the particular use contemplated. Therefore, the foregoing description is to be considered exemplary, rather than limiting, and the true scope of the invention is that described in the following claims.

I claim:

1. An internal combustion engine comprising a crankcase having a crankshaft defining a longitudinal, crankshaft axis, a first cylinder bank extending from said crankcase and defining a first cylinder bank plane which intersects said crankshaft axis, and a second cylinder bank extending from said crankcase defining a second cylinder bank plane which intersects said crankshaft axis at an angle to said first cylinder bank plane, said angle defining a crankcase valley therebetween, each of said cylinder banks having a cylinder with a combustion chamber, an intake valve and an exhaust valve, said valves operable to regulate fluid flow through said combustion chamber, said engine further comprising a first, longitudinally extending exhaust camshaft and a second longitudinally extending intake camshaft located for rotation within said crankcase valley along a plane bisecting said angle defining said crankcase valley and intersecting said longitudinal, crankshaft axis wherein said crankshaft, said intake camshaft and said exhaust camshaft extend in parallel relationship on said bisecting plane of said engine valley, said camshafts driven by said crankshaft and having cam lobes located thereon, each intake valve in operable communication with a cam lobe of said intake camshaft through an intake valve actuator extending between said intake cam lobe and said intake valve and each exhaust valve in operable communication with a cam lobe of said exhaust camshaft through an exhaust valve actuator extending between said exhaust cam lobe and said exhaust valve.

2. An internal combustion engine comprising a crankcase having a crankshaft defining a longitudinal, crankshaft axis, a first cylinder bank extending from said crankcase and defining a first cylinder bank plane which intersects said crankshaft axis, and a second cylinder bank extending from said crankcase defining a second cylinder bank plane which intersects said crankshaft axis at an angle to said first cylinder bank plane, said angle defining a crankcase valley between said cylinder banks, each of said cylinder banks having a cylinder with a combustion chamber, an intake valve and an exhaust valve, said valves operable to regulate fluid flow through said combustion chamber, said engine further comprising a first, longitudinally extending camshaft and a second longitudinally extending camshaft located, for rotation within said crankcase valley, along a plane bisecting said angle defining said crankcase valley, and intersecting said longitudinal, crankshaft axis wherein said crankshaft, said first camshaft and said second camshaft extend in parallel relationship on said bisecting plane of said engine valley and, wherein each intake and exhaust valve is in operable communication with one of said camshafts through a valve actuator extending between said cam lobe and said valve.

3. An internal combustion engine, as defined in claim 2, said crankshaft and said second camshaft interconnected by an intermediate hub and said crankshaft and said first camshaft interconnected by a camshaft phasing apparatus operable with said intermediate hub to vary relative rotation of said first and said second camshafts.

* * * * *